US009534422B1

(12) United States Patent
Andersen

(10) Patent No.: US 9,534,422 B1
(45) Date of Patent: Jan. 3, 2017

(54) LATCH FITTING TOOL

(71) Applicant: SAFE AND CARE LTD., Hong Kong (CN)

(72) Inventor: Jesper Birk Andersen, Hong Kong (CN)

(73) Assignee: Safe and Care LTD., Hong Kong (CN)

( * ) Notice: Subject to any disclaimer, the term of this patent is extended or adjusted under 35 U.S.C. 154(b) by 0 days.

(21) Appl. No.: 15/145,134

(22) Filed: May 3, 2016

(30) Foreign Application Priority Data

Jul. 21, 2015 (CN) ..... 2015 2 0531347 U

(51) Int. Cl.

| | |
|---|---|
| ***E05B 65/06*** | (2006.01) |
| ***E05B 65/00*** | (2006.01) |
| ***A47B 67/02*** | (2006.01) |
| ***A47B 77/00*** | (2006.01) |
| ***A47B 81/00*** | (2006.01) |
| ***A47B 97/00*** | (2006.01) |
| ***E05C 7/04*** | (2006.01) |
| ***E05B 35/00*** | (2006.01) |
| ***E05B 65/46*** | (2006.01) |

(52) U.S. Cl.
CPC ..... *E05B 65/0014* (2013.01); *A47B 67/02* (2013.01); *A47B 77/00* (2013.01); *A47B 81/00* (2013.01); *A47B 97/00* (2013.01); *E05B 35/008* (2013.01); *E05B 65/0003* (2013.01); *E05B 65/06* (2013.01); *E05B 65/46* (2013.01); *E05C 7/04* (2013.01); *A47B 2067/025* (2013.01); *A47B 2230/07* (2013.01)

(58) Field of Classification Search
CPC ..... E05B 65/46; E05B 65/0014; E05B 65/06; E05B 65/0003; E05B 35/008; A47B 67/02; A47B 77/00; A47B 81/00; A47B 97/00; A47B 2067/025; A47B 2230/07; E05C 7/04
USPC ..... 70/78–83; 292/DIG. 37
See application file for complete search history.

(56) References Cited

U.S. PATENT DOCUMENTS 537,746 A * 4/1895 Boyum ..... E05B 65/0811 292/128
754,721 A * 3/1904 Tower ..... E05C 3/30 232/23
767,567 A * 8/1904 Keil ..... E05C 3/30 292/108
1,784,935 A * 12/1930 Johnson ..... E05B 63/248 292/221
2,437,299 A * 3/1948 Jacobi ..... E05C 5/00 292/168

(Continued)

FOREIGN PATENT DOCUMENTS

CA 2417948 A1 8/2004

*Primary Examiner* — Suzanne Barrett
(74) *Attorney, Agent, or Firm* — Fay Sharpe LLP

(57) ABSTRACT

The disclosure relates to a child safety lock mechanism for a cupboard, the cupboard includes at least one movable door and fixed frame, the locking mechanical system includes an external section arranged on the outside of the cupboard door, an internal section secured to a part of the frame, a latching means and a releasing means, wherein the external section is removably lockable to the internal section by the latching means and releasable by the releasing means. The latching means and releasing means are mutually engageable to release the latch, and extend from a first surface of the door to a second surface of the door to effect the engagement.

4 Claims, 8 Drawing Sheets

(56) References Cited

U.S. PATENT DOCUMENTS

| | | | | | |
|---|---|---|---|---|---|
| 2,573,061 | A * | 10/1951 | Raymond | E05B 83/30 | 292/DIG. 37 |
| 3,589,152 | A * | 6/1971 | Glass | E05B 63/0017 | 292/140 |
| 3,782,139 | A * | 1/1974 | Rubner | E05C 1/16 | 292/169 |
| 3,971,237 | A * | 7/1976 | Rasmussen | E05B 15/143 | 292/19 |
| 4,435,966 | A * | 3/1984 | Craig | E05B 65/5276 | 220/210 |
| 4,895,401 | A * | 1/1990 | Thornton | E05B 63/248 | 292/254 |
| 5,626,372 | A | 5/1997 | Vogt | | |
| 5,975,593 | A * | 11/1999 | Cress | E05B 53/001 | 292/101 |
| 6,029,335 | A | 2/2000 | Hui et al. | | |
| 6,250,730 | B1 | 6/2001 | Roth et al. | | |
| 7,393,024 | B2 * | 7/2008 | Bella | E05B 83/30 | 292/170 |
| 8,100,443 | B2 * | 1/2012 | Talpe | E05B 13/005 | 292/336.3 |
| 8,534,718 | B2 * | 9/2013 | Loret de Mola | E05B 5/00 | 292/165 |
| 8,919,832 | B1 * | 12/2014 | Lynch | E05B 13/005 | 292/140 |
| 2006/0082163 | A1 * | 4/2006 | Dionysian | E05B 65/0014 | 292/170 |
| 2011/0088436 | A1 * | 4/2011 | Cioni | E05B 65/46 | 70/85 |

* cited by examiner

LATCH FITTING TOOL

CROSS REFERENCE TO RELATED APPLICATION

This application claims priority to and the benefit of Chinese Patent Application No. ZL201520531347.9, filed Jul. 21, 2015, the entirety of which is hereby incorporated by reference as if fully set forth herein.

The present invention relates to a latch for cupboards, cabinet doors and the like, and, more particularly, "child-proof" latches that include features which make them difficult to be actuated by small children.

BACKGROUND OF THE INVENTION

Cupboards are commonly used in daily life in kitchens, bedrooms, offices, etc. to store a wide range of articles, some of which may be harmful to children. Small children may also attempt to climb on, or even in, cupboards and cabinets in an effort to hide. Cupboards and cabinets may house many types of materials which may be potentially hazardous to children such as medicines, household cleaners, knives, tools, paint, etc.

To prevent young children from accessing these storage areas, numerous items have been patented and sold, most of a multi-piece assembly. Generally, some sort of a longitudinal member with a hook portion is attached to either side surface of a cupboard or cupboard handle to limit the amount the cupboard door may be opened. The hook portion may engage with the cupboard handles or fixings on the cupboard doors. A latch on the hook may be depressed to release the hook from the cupboard handles or fixings on the cupboard doors.

While the disengagement of the latch is relatively easy for an adult, the latches are intended to be difficult to manipulate by a child. However, since the actuation may be easily learned by an attentive child, the latch may soon prove inadequate.

In some cases, these hooks require at least two components, which need alignment during installation or adjustment after installation. These components generally include protrusions fixed to the cupboard door for the hook to latch around. This mechanism may further require a biasing member (springs, etc.) to bias the latch member against the hook member.

These hooks allow a certain amount of operability of the cupboard doors allowing their partial opening due the playability of the material used or a looseness of the fixing.

What is needed is a "child-proof" safety lock that is easy to install on at least one cupboard door, and which includes a more complex action which must be actuated to release the lock. Thus, a cupboard door may not be partially opened and its contents kept secure from children. Upon actuation of the more complex action by an adult, the contents may become accessible.

It is thus an object of the present invention to provide a lock which may preferably be moulded of plastic to provide a low cost safety latch.

DETAILED DESCRIPTION

The present invention is described more fully hereinafter with reference to the accompanying drawings, in which preferred embodiments of the invention are shown. This invention, may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
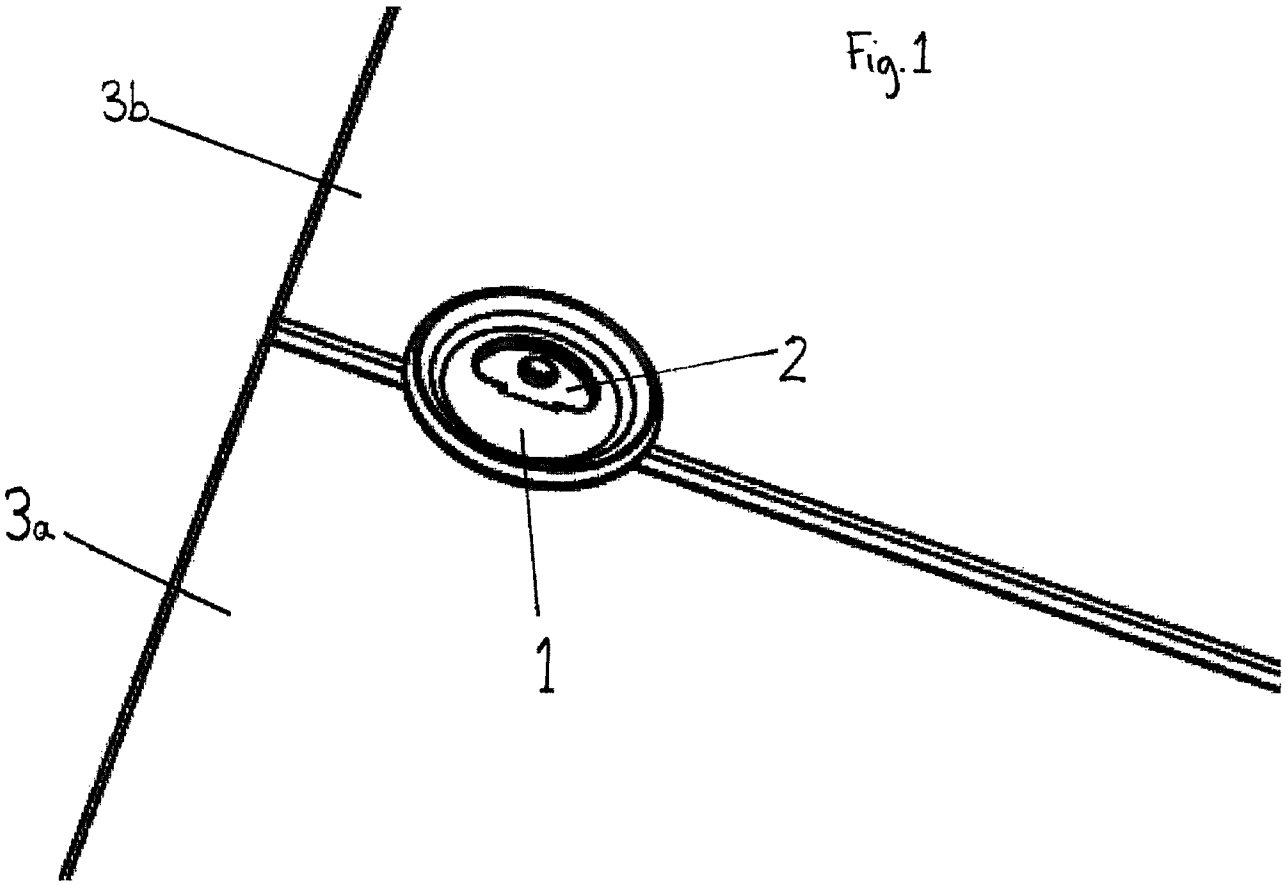
FIG. 1: shows a perspective view of a first embodiment showing a front part of a lock mechanism of the invention while in use.
Figure 2:
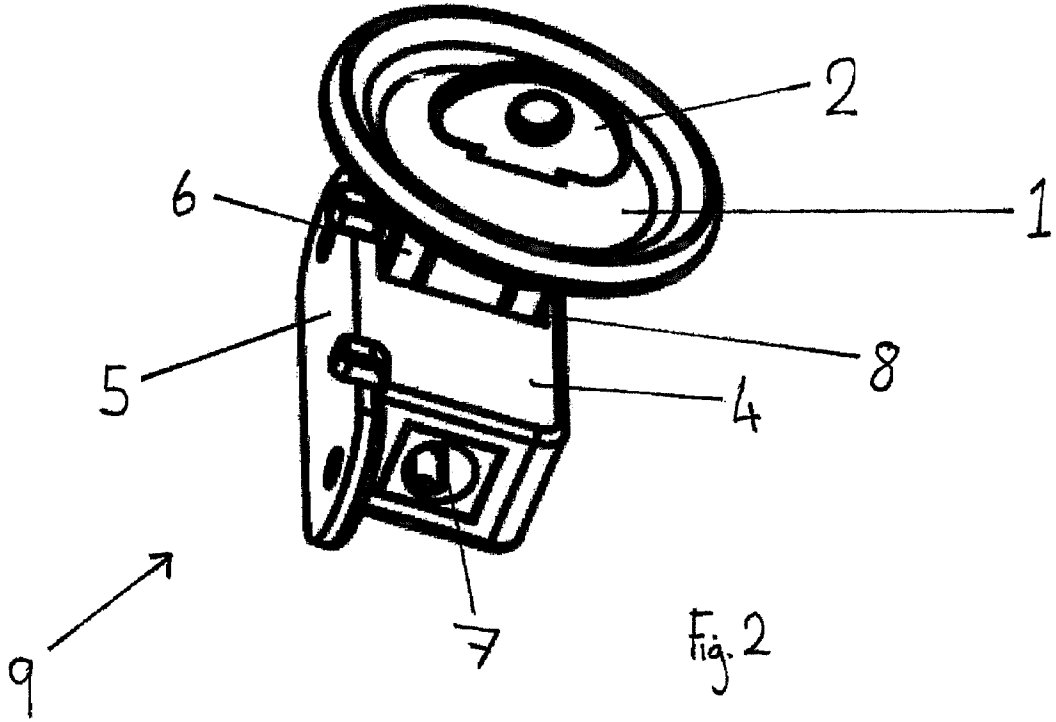
FIG. 2: shows a perspective left side view of the first embodiment of the lock mechanism of the invention.
Figure 3:
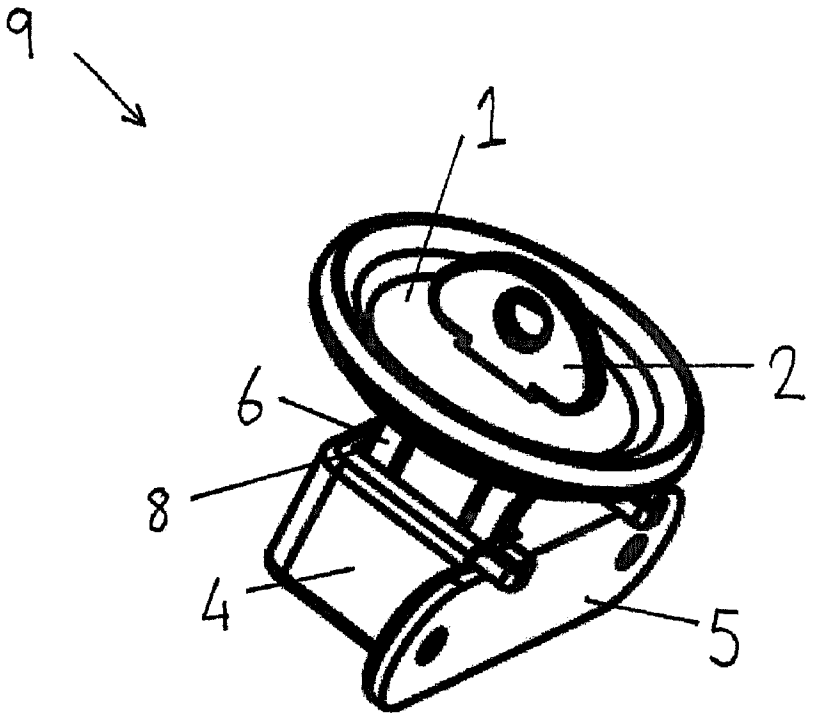
FIG. 3: shows a perspective right side view of the first embodiment of the lock mechanism of the invention.
Figure 4:
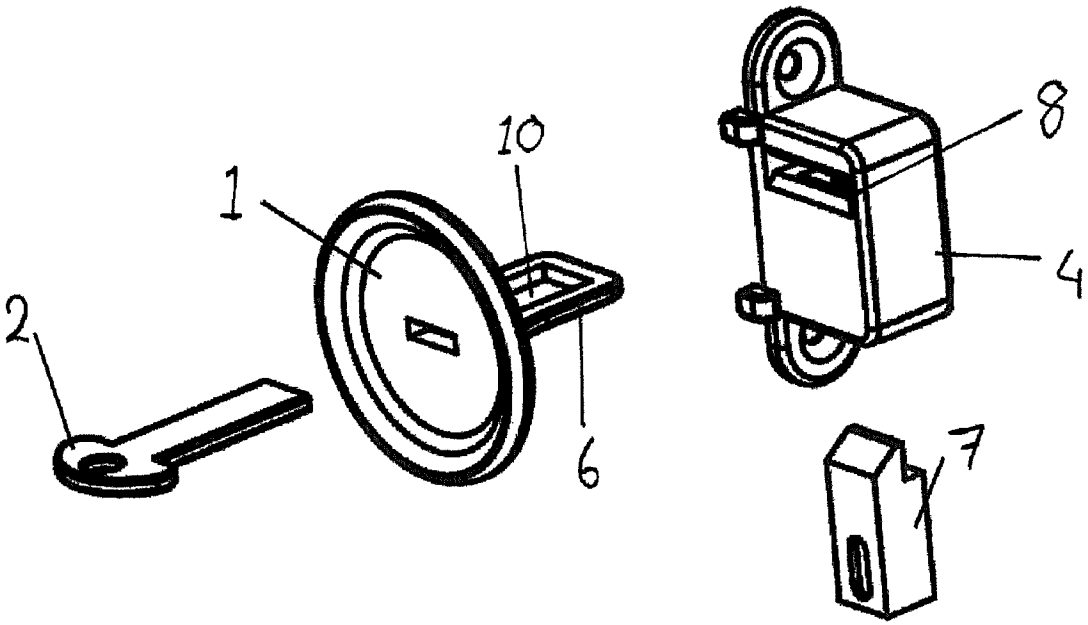
FIG. 4: shows a perspective view of the disassembled lock mechanism of the first embodiment of the invention.

Referring now to FIGS. 1 to 4, a first embodiment of a childproof lock mechanism, according to the present invention, is illustrated in perspective view. The lock mechanism 9 includes an external section 1 arranged to fit against the outside surface of the cupboard doors 3*a* and 3*b*. The external section 1 includes a latching means 6 which protrudes between the adjacent edges of the cupboard doors 3*a* and 3*b* and comprises a latch aperture 10. In this embodiment an internal section 4 is fixed to a horizontal shelf on the inside of the cupboard by attaching means 5. The internal section 4 of the lock mechanism receives the latching means 6 on the inside of the cupboard via the housing aperture 8. The latching means 6 enters the internal section 4 and compresses a spring loaded bolt 7 by engagement of its front end with a ramped surface on the bolt 7. Once the latching means 6 is fully engaged into the internal section 4 the bolt returns through the latch aperture 10 in the latching means 6 as shown in FIG. 4.

Once the spring loaded bolt 7 has engaged the latching means 6 the external section 1 and the internal section 4 become locked together, retaining the cupboard doors 3 between the two sections 1 and 4. The internal section 4 being attached to the inside of the cupboard by attaching means 5 prevents opening of the cupboard doors 3*a* and 3*b* when latching means 6 and spring loaded bolt 7 are engaged.

Holes are provided in the attaching means 5 for attachment to the inside surface of a cupboard with mechanical fasteners, such as small nails or screws. Double-sided adhesive tape or hook-and-loop type fasteners, such as Velcro® may also be used.

The latching means 6 may be disengaged from the internal section 4 by a recompression of the spring loaded bolt 7 by releasing means 2. The releasing means 2, as shown in FIGS. 1 to 4, is located on the external section 1 and is there for actuated from the outside of the cupboard. The releasing means 2 disengages the spring loaded bolt 7 by its end pressing the ramped end of the bolt 7, allowing the cupboard doors to be opened.

In the first embodiment, shown in FIGS. 1 to 4, the releasing means 2 is a removable key which compresses the spring loaded bolt 7 in the internal section 4 by passing through the external section and between the cupboard doors 3 and into the latch aperture 10 to disengage the spring loaded bolt 7. The removable key allows the cupboard to be accessible by only the key holder, which restricts access of the cupboard by children.

Figure 8:
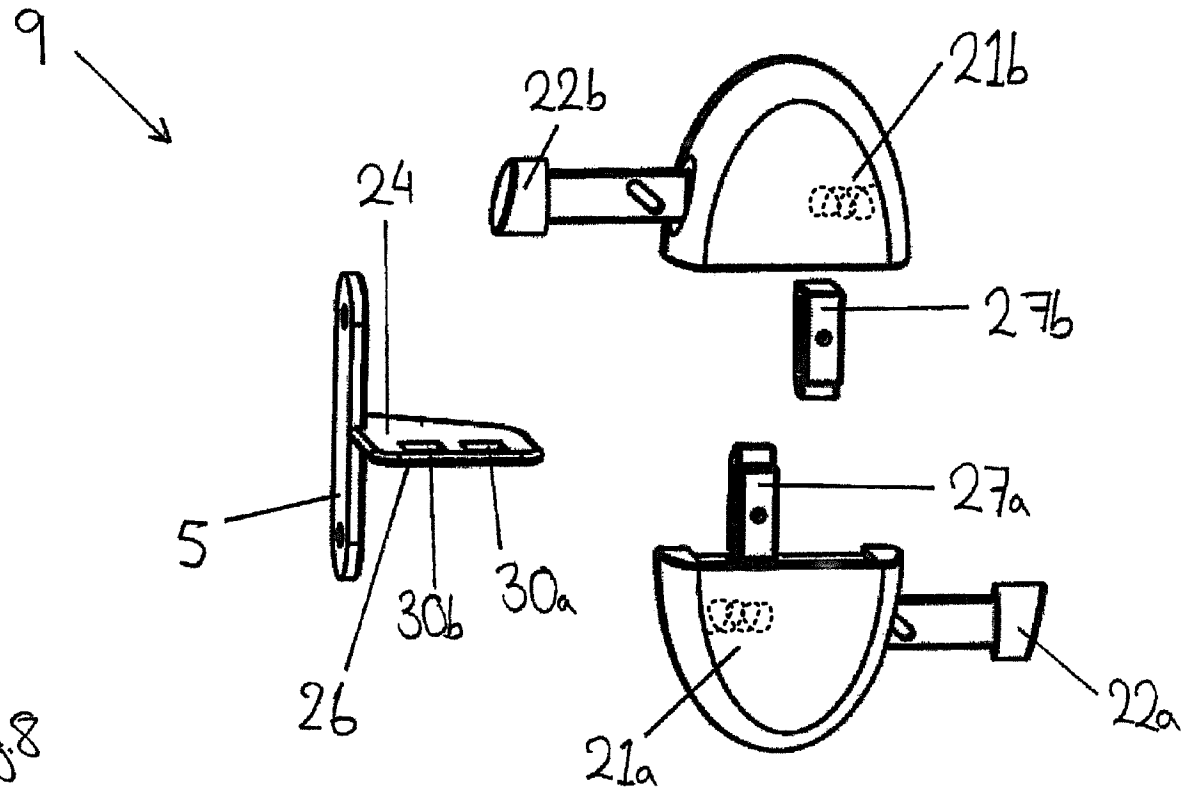
FIG. 8: shows a perspective view of the lock mechanism disassembled of the second embodiment of the invention.

In the second embodiment, shown in FIGS. 5 to 8, there are two spring loaded bolts 27*a* and 27*b* located in the external sections 21*a* and 21*b*. The latching means 26 is fixed to the internal section 24 and has two latch apertures 30*a* and 30*b* as shown in FIG. 8 which, when fitted are aligned with the bolts 27*a* and 27*b*. The releasing means consists of two compressible buttons 22*a* and 22*b* which when actuated compress the spring loaded bolts 27*a* and 27*b*, releasing the latching means 26 from the external sections 21*a* and 21*b*.

Figure 5:
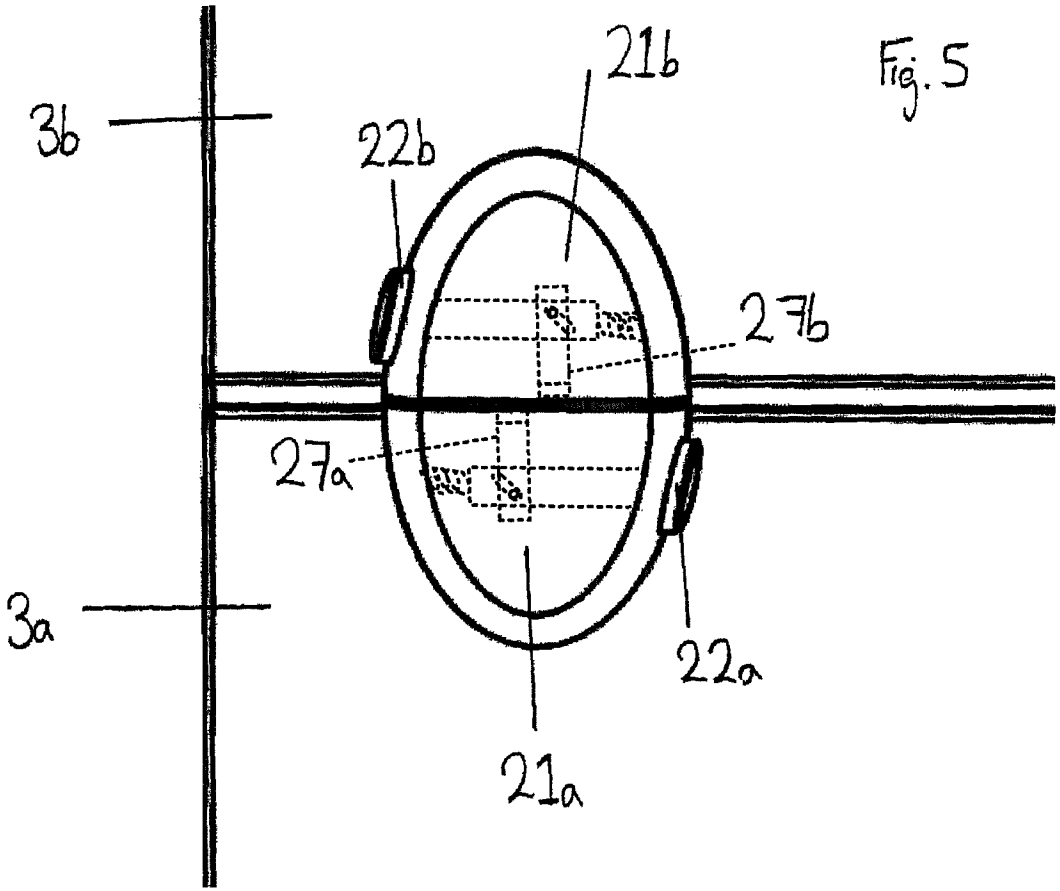
FIG. 5: shows a perspective view of a second embodiment showing a front part of a lock mechanism of the invention while in use.
Figure 6:
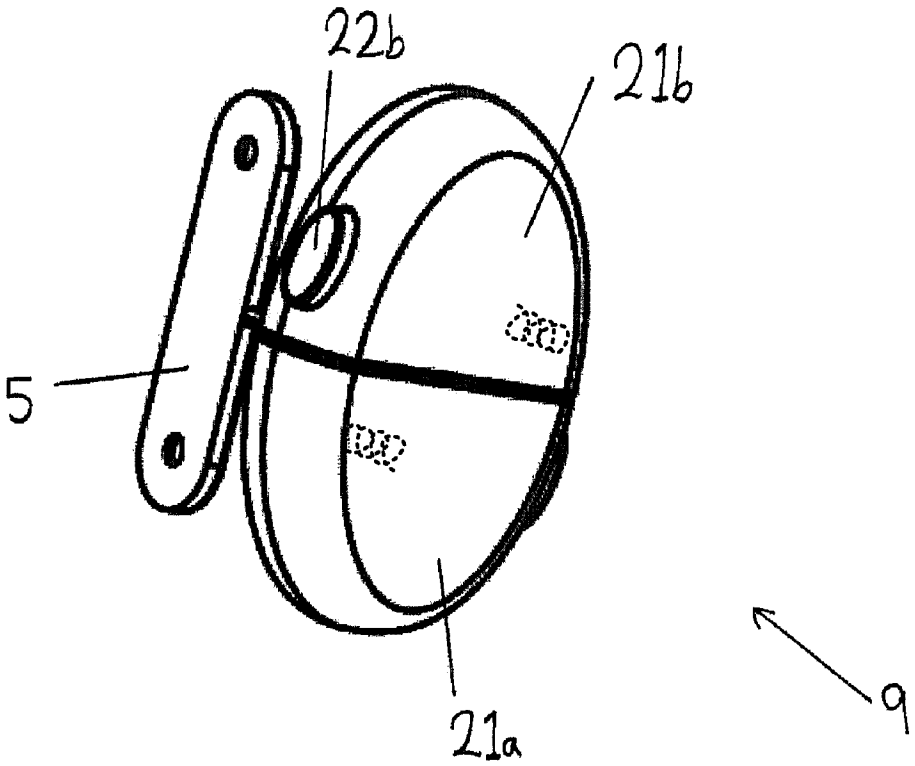
FIG. 6: shows a perspective right side view of the second embodiment of the lock mechanism of the invention.
Figure 7:
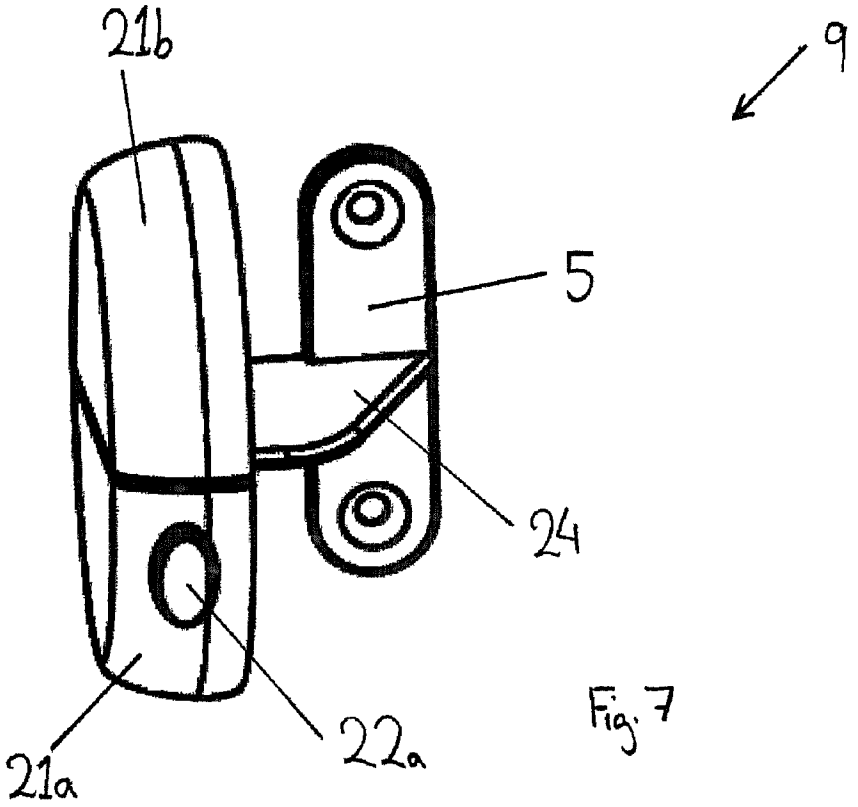
FIG. 7: shows a perspective bottom side view of the second embodiment of the lock mechanism of the invention.

In this second embodiment the internal section 24 is also attached to a horizontal shelf in the cupboard by attaching means 5. However, the external section is split into two halves 21*a* and 21*b* and these are attached to the external surface of the cupboard doors 3*a* and 3*b* by an adhesive or double-sided tape as shown in FIG. 5. The requirement to actuate the buttons before opening makes access of the cupboard by young children difficult.

By having two releasing means 23*a* and 23*b*, this second embodiment has the advantage of being able to open each cupboard door 4*a* and 4*b* independently.

The lock is mechanically actuated when the cupboard door is closed by the ramped ends of the bolts 27*a* and 27*b* which enable the bolts to slide over the edge of the latching means 26 and catch onto the apertures 30*a* and 30*b* automatically when the cupboard door is closed.

It should be understood that although specific embodiments of the present invention have been described herein in detail, such descriptions are for purposes of illustration only and modifications may be made thereto within the scope of the invention.

The description and drawings illustratively set forth the presently preferred invention embodiment. We intend the description and drawings to describe this embodiment and not to limit the scope of the invention. Obviously, it is possible to modify these embodiments while remaining within the scope of the following claims. Therefore, within the scope of the claims one may practice the invention otherwise than as the description and drawings specifically show and describe.

The invention claimed is:

1. A child safety locking mechanism for a cupboard comprising at least one movable door and a fixed frame, and a locking mechanism comprising:

first and second external sections arranged on the outside of a cupboard door;

an internal section secured to a part of the frame;

a latching means and a releasing means;

two spring loaded bolts located in the external sections, wherein the external sections are removably lockable to the internal section by the latching means and releasable by the releasing means;

wherein the latching means and releasing means are mutually engageable to release the latching means, and extend from a first surface of the door to a second surface of the door, to effect the engagement;

wherein the latching means is fixed to the internal section and has two latch apertures, which, when fitted, are aligned with the bolts; and wherein the releasing means includes two compressible buttons, which, when actuated, compress the spring loaded bolts releasing the latching means from the external sections, such that actuating both buttons releases the latching means to allow the cupboard to be opened.

2. A child safety locking mechanism according to claim 1, wherein the frame is part of a shelf.

3. A child safety locking mechanism according to claim 1, wherein the internal section is affixed to the inside of a cupboard by an attaching means.

4. A child safety locking mechanism for a cupboard comprising at least one movable door and a fixed frame, and a locking mechanism comprising: an external section arranged on the outside of a cupboard door, an internal section secured to a part of the frame, a latching means and a releasing means, wherein the external section is removably lockable to the internal section by the latching means and releasable by the releasing means; wherein the latching means and releasing means are mutually engageable to release the latching means, and extend from a first surface of the door to a second surface of the door, to effect the engagement; and wherein the releasing means is located in the internal section.

* * * * *